US006240670B1

(12) United States Patent
Findlay

(10) Patent No.: US 6,240,670 B1
(45) Date of Patent: Jun. 5, 2001

(54) LOCKING MECHANISM FOR FIREARMS

(75) Inventor: David S. Findlay, Mohawk, NY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 09/390,159

(22) Filed: Sep. 3, 1999

(51) Int. Cl.[7] ..... F41A 17/64

(52) U.S. Cl. ..... 42/70.08; 42/70.11; 42/16; 89/148; 89/185

(58) Field of Search ..... 42/70.08, 16, 70.11; 89/148, 185

(56) References Cited

U.S. PATENT DOCUMENTS

| | | | | |
|---|---|---|---|---|
| D. 34,563 | | 5/1901 | Newman . | |
| 0,263,244 | | 8/1882 | Taylor . | |
| 1,305,830 | * | 6/1919 | Mudd | 42/16 |
| 1,461,387 | * | 7/1923 | Fearn | 42/70.08 |
| 1,958,603 | | 5/1934 | Bacon | 70/47 |
| 2,049,548 | | 8/1936 | Swanson . | |
| 2,819,551 | | 1/1958 | Baierl . | |
| 2,856,718 | | 10/1958 | Fischer . | |
| 3,553,877 | | 1/1971 | Welch et al. . | |
| 3,624,945 | | 12/1971 | Foote . | |
| 3,648,562 | * | 3/1972 | Loeble | 89/185 |
| 3,673,725 | | 7/1972 | Cravener | 42/70.11 |
| 3,882,622 | | 5/1975 | Perlotto | 42/70.11 |
| 4,021,955 | * | 5/1977 | Curtis | 42/70.08 |
| 4,532,729 | | 8/1985 | Von Muller | 42/70.11 |
| 4,726,136 | * | 2/1988 | Dornaus et al. | 42/70.08 |
| 5,241,769 | | 9/1993 | Von Muller | 42/70.11 |
| 5,467,550 | | 11/1995 | Mumbleau | 42/70.11 |
| 5,553,473 | | 9/1996 | Keller | 70/358 |
| 5,671,560 | | 9/1997 | Meller | 42/70.11 |
| 5,910,003 | | 6/1999 | Kleinpaul | 42/70.11 |

FOREIGN PATENT DOCUMENTS

| | | | | |
|---|---|---|---|---|
| 696034 | * | 9/1940 | (DE) | 42/70.08 |
| 4303333 | | 2/1993 | (DE) . | |
| 858485 | * | 11/1940 | (FR) | 42/70.08 |

* cited by examiner

*Primary Examiner*—Stephen M. Johnson
(74) *Attorney, Agent, or Firm*—Huntley & Associates

(57) ABSTRACT

A locking mechanism for use in a wide variety of firearms to assist in securing the firearm from unauthorized use, the locking mechanism being rotatable between an unlocked position where it allows movement of the firing pin and a locked position where it prevents movement of the firing pin.

23 Claims, 5 Drawing Sheets

LOCKING MECHANISM FOR FIREARMS

BACKGROUND OF THE INVENTION

This invention relates generally to locking mechanisms for use in firearms and more particularly to a lock that blocks the firing pin of a firearm. The invention is particularly suitable for blocking the firing pin of a bolt action firearm. Regardless of the type of firearm in which the present invention is incorporated, it provides an additional means by which firearms can be secured to deter unauthorized use.

SUMMARY OF THE INVENTION

The various embodiments of the locking mechanisms of the present invention provide an integral device that can assist in deterring unauthorized use of a firearm by providing a lock that can be activated to prevent the firing pin from moving.

Specifically, the present invention provides a firearm having a firing pin and a locking mechanism comprising: a lock button, rotatable between an unlocked position, wherein the lock button permits movement of the firing pin, and a locked position, wherein the lock button prevents movement of the firing pin, wherein the lock button comprises a longitudinal axis, a surface, and a first end and a second end, and; i. a locking aperture formed along the longitudinal axis of the button and comprising a female receiving end formed in the first end of the button; ii. a notch formed in the surface of the button between the first and second ends of the button; and iii. a plunger aperture formed in the surface of the button between the first and second ends of the button, and wherein the locking mechanism further comprises a detent plunger and a locking means for insertion into the female receiving end of the locking aperture of the safety button, and wherein the plunger aperture is connected to the locking aperture, and wherein the firing pin has a notch formed therein positioned and configured to interact with the notch of the lock button.

The present invention also provides a bolt action firearm having a bolt assembly comprising a hollow bolt body, a bolt handle, a bolt plug, a firing pin and firing pin spring within the bolt body, and a locking mechanism comprising a lock button having a longitudinal axis, a surface, and a first end and a second end, and comprising; i. a locking aperture formed along the longitudinal axis of the button and comprising a female receiving end formed in the first end of the button; ii. a notch formed in the surface of the button between the first and second ends of the button; and iii. a plunger aperture formed in the surface of the button between the first and second ends of the button and connected to the locking aperture, and wherein the locking mechanism further comprises a detent plunger, and a locking means for insertion into the female receiving end of the locking aperture of the safety button, and wherein the lock button is moveable among a locked and an unlocked position, and wherein the firing pin has a notch formed therein positioned and configured to interact with the notch of the lock button to permit movement of the firing pin when the lock button is in the unlocked position and to prevent movement of the firing pin when the lock button is in the locked position.

In addition, the present invention provides a firearm having a firing pin and a locking mechanism comprising: A. a lock button having a longitudinal axis, a surface, a first end and a second end, and comprising: i. a locking aperture formed along a the longitudinal axis of the button comprising a female receiving end formed in the first end of the button; ii. a notch formed in the surface of the button between the first and second ends of the button; iii. a plunger aperture formed in the surface of the button between the first and second ends of the button, extending substantially transverse to the longitudinal axis of the button toward the central axis of the button and connecting with the substantially longitudinal locking aperture; iv. a plunger channel formed in the surface of the button between the first and second ends thereof, and connected to the plunger aperture; B. a detent plunger; C. a spring positioned to bias the detent plunger towards the lock button and into a position where the detent plunger interacts with the plunger aperture and plunger channel; and D. a key adapted for insertion into the female receiving end of the locking aperture of the button, wherein the key is adapted to interact with the plunger aperture when inserted into the female receiving end; and wherein the firing pin has a notch formed therein and adapted to interact with the notch of the lock button.

DETAILED DESCRIPTION OF THE INVENTION

Figure 1:
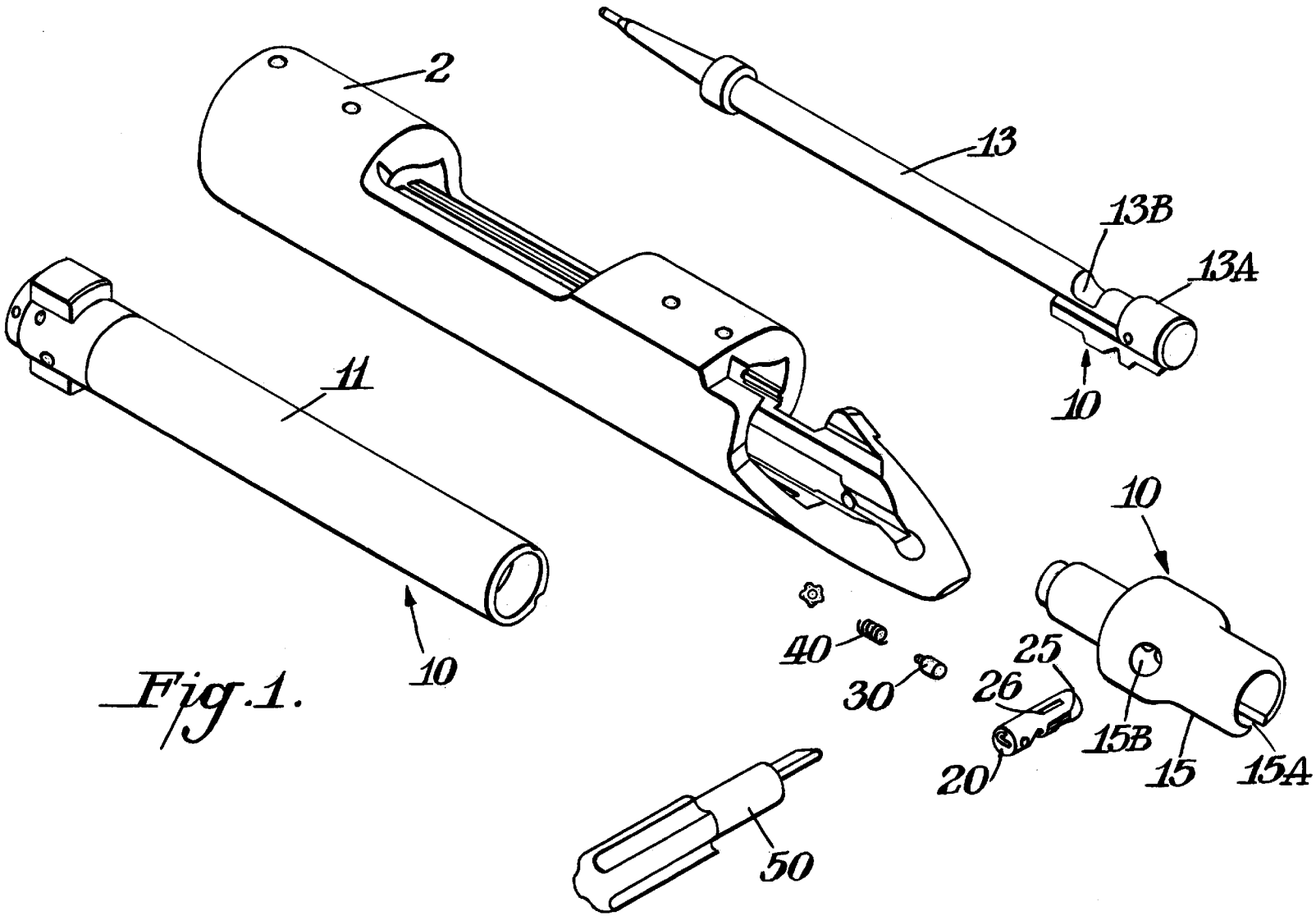
FIG. 1 is an exploded view of a firearm action showing a receiver, exploded bolt assembly, and one embodiment of a locking mechanism of the present invention.
Figure 2:
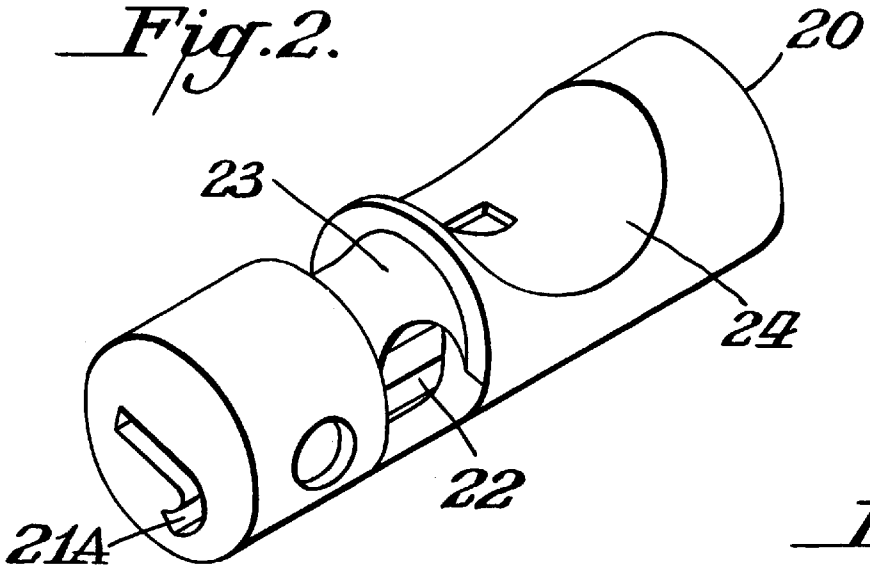
FIG. 2 is a right side elevational view of one embodiment of a lock button of the present invention.
Figure 3:
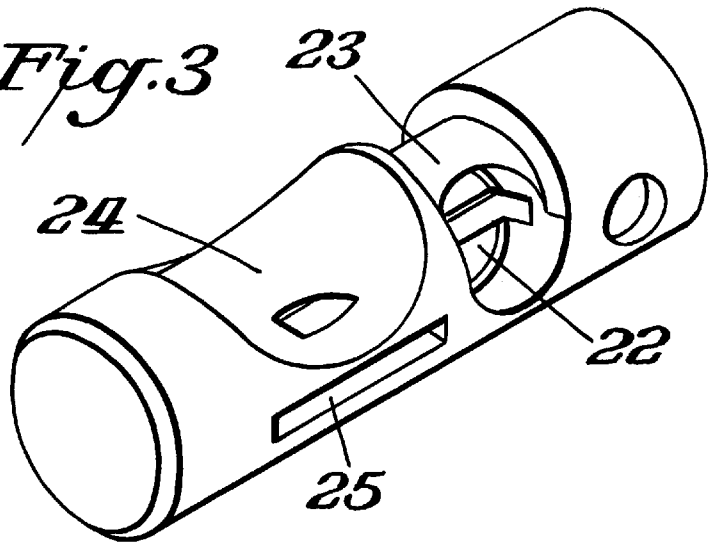
FIG. 3 is a left side elevational view of the lock button shown in FIG. 2.
Figure 4:
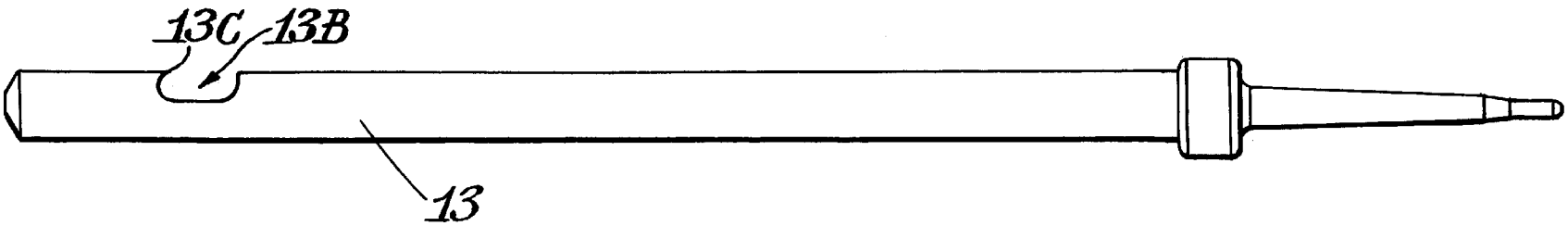
FIG. 4 is a side elevational view of a firing pin that can be used in firearms having a locking mechanism of the present invention.
Figure 5:
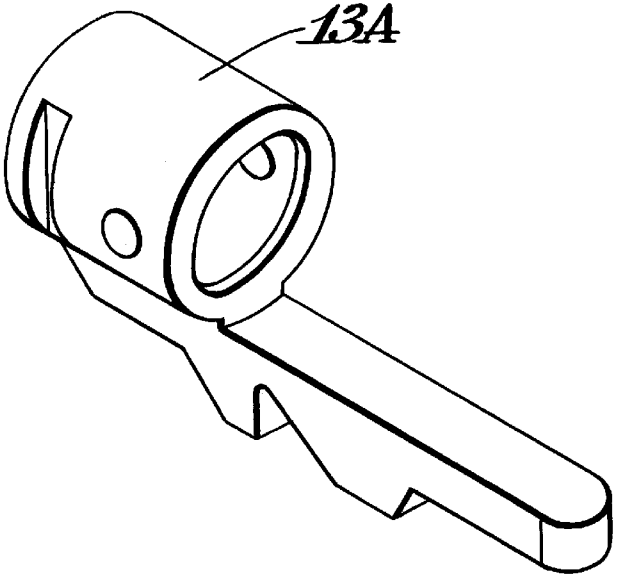
FIG. 5 is a side elevational view of a firing pin head that can be used with the firing pin in FIG. 4 and in firearms having a locking mechanism of the present invention.
Figure 7:
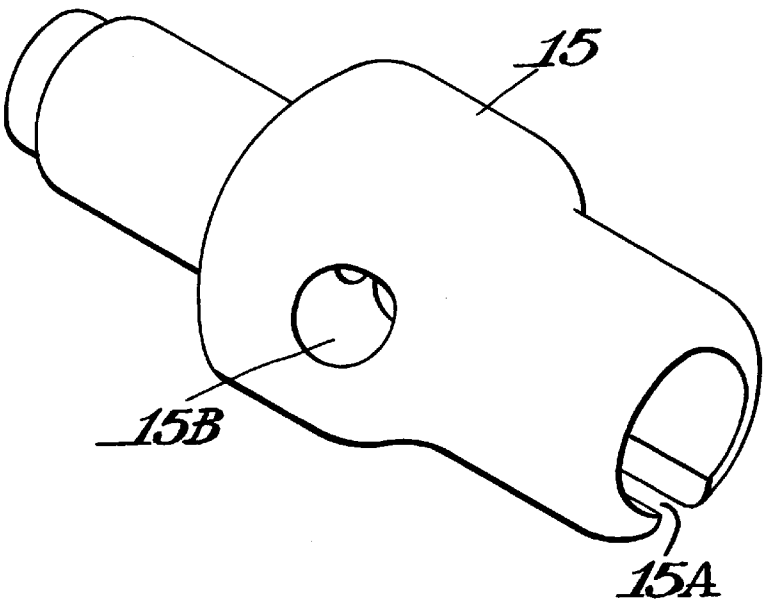
FIG. 7 is a left side elevational view of a bolt plug that can be used in a firearm having a locking mechanism of the present invention.
Figure 6:
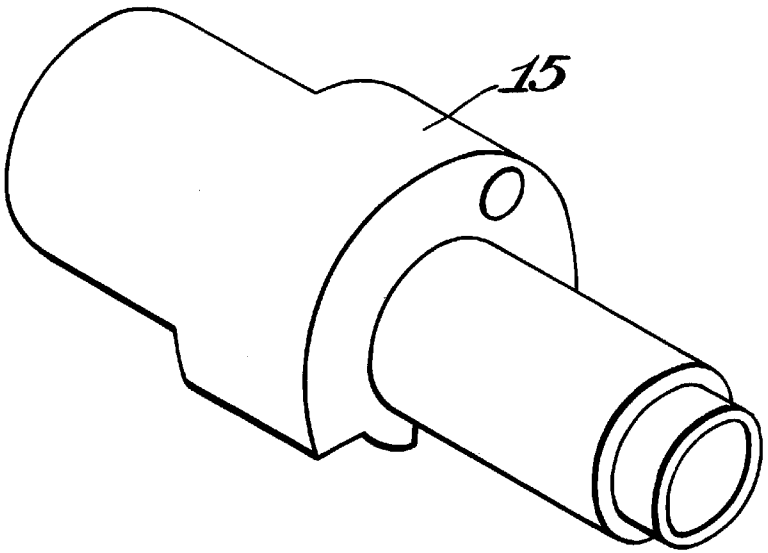
FIG. 6 is a right side elevational view of a bolt plug that can be used in a firearm having a locking mechanism of the present invention.

The present invention will be more fully understood by reference to the drawings, which show one preferred embodiment of a locking mechanism of the present invention. Variations and modifications of this embodiment can be substituted without departing from the principles of the invention, as will be evident to those skilled in the art.

The locking mechanism shown in the figures is one preferred embodiment of the present invention, adapted for use in a bolt action firearm. This embodiment can be adapted for use in a wide variety of bolt action firearms, as will be evident to those skilled in the art. As shown in the figures, a preferred embodiment of a locking mechanism of the present invention is adapted for use with a firearm having a specific type of bolt assembly, however, the invention is not limited to such types of bolt assemblies.

In the figures, the firearm (not shown) comprises a bolt assembly 10. As is typical, the bolt assembly is slideably mounted in the receiver 2 of the firearm, and can be removed from the receiver. Also typical of many such bolt assemblies, the bolt assembly shown in the figures is also rotatable, typically when in the closed position, where it can be rotated from the closed position to the closed and locked position. When in the closed and locked position, the firearm is ready to fire a round of ammunition within the chamber, not shown.

The bolt assembly 10 comprises a bolt body 11 and a bolt handle (not shown) attached thereto to provide a means of rotating the bolt assembly and for sliding the bolt assembly. The bolt handle is typically attached to some part of the bolt assembly, preferably the bolt body. A firing pin 13 is moveable within the bolt body and is urged forward by a firing pin spring (not shown). A firing pin head 13A at the rear of the firing pin is adapted to interact with the fire control mechanism or trigger assembly to cock the firing pin by urging it against the firing pin spring, and to allow for the release of the firing pin upon trigger pull. The firing pin and firing pin spring are retained within the bolt body by a bolt plug 15. The bolt plug 15 is a hollow cylinder, open at its forward end where it connects with the bolt body and closed at its rear end.

The bolt plug is a typical means of retaining the firing pin and firing pin spring within the bolt body, however, other means of retaining these components can be used. Although the bolt plug shown in the figures slides with the bolt assembly, it does not rotate with the bolt body and bolt handle. Other embodiments of the present invention having rotating bolt plugs can also be used according to the present invention.

The bolt plug is threaded to the bolt body, and further comprises a slot 15A, adapted to allow longitudinal movement of the firing pin head. The bolt plug can be attached to the bolt body by various other means, as will be evident to those skilled in the art.

The embodiment of the locking mechanism of the present shown in the figures is adapted to interact with the rear portion of the firing pin, and is thus positioned in the bolt plug, at the rear of the bolt assembly. An aperture 15B is formed in the bolt plug, extending perpendicular to the bolt assembly and connecting with the hollow interior of the bolt plug. The aperture 15B is adapted for insertion of a locking mechanism of the present invention.

The embodiment of the locking mechanism of the present invention shown in the figures comprises a lock button 20, a detent plunger 30, a detent plunger spring 40, and a locking means or key 50.

The lock button 20 has a locking aperture 21 formed along a substantially longitudinal axis of the button and having a female receiving means 21A formed in one end of the button. The locking aperture connects to the plunger aperture 22, which is formed between the two ends of the button and extends substantially transverse to the longitudinal axis of the button towards the center of the button, where it connects with the locking aperture. The plunger aperture 22 is connected to a substantially transverse plunger channel 23. The plunger channel 23, in the embodiment shown, extends circumferentially and is formed in the surface of the button. The interaction of the plunger channel and the detent plunger serves to guide and restrict the rotational movement of the button between the locked and unlocked positions.

The lock button also has a notch 24 formed in the surface thereof, between the two ends of the button. The notch 24 is adapted to allow movement of the firing pin 13 when the button is in the unlocked position, and to prevent movement of the firing pin when the button is in the locked position. The firing pin 13 has a notch 13B formed therein, positioned to interact with the notch 24 of the lock button. Typically the firing pin does not rotate, and thus the firing pin notch will only move longitudinally with the firing pin. In the embodiment shown in the figures, the firing pin notch always faces up, and when the lock button is in the unlocked position, the two notches are aligned, allowing movement of the firing pin without interference from any portion of the button. When the button is rotated to the locked position, the notch 24 is rotated away from alignment with the firing pin and firing pin notch, and the lock button thus interacts with the firing pin notch to prevent the firing pin from moving longitudinally.

In preferred embodiments of the present invention, as shown in the figures, the lock button further comprises two parallel slots, 25 and 26, that are formed in the surface of the button and oriented along the longitudinal axis of the button. In such embodiments, the firing pin further comprises a tab 13C formed adjacent to the notch 13B. The tab 13C is adapted to interact with either of the slots to prevent movement of the firing pin, and acts as an additional safety measure, to prevent accidental release of the firing pin.

When the detent plunger is in the plunger aperture, the lock button is in the locked position, wherein a portion of the plunger extends through the plunger aperture and into the locking aperture. When the detent plunger is in the plunger aperture, the lock button does not prevent the trigger from being activated, however, it blocks the firing pin from moving forward to strike a round of ammunition, and thus prevents the firearm from being fired.

When the button is in the locked position, it cannot be rotated to the unlocked position until the locking means is inserted into the locking aperture to a position where the locking means contacts the detent plunger and urges it away from the lock button, thus removing the detent plunger from within the plunger aperture and allowing the lock button to be rotated so that the detent plunger interacts with the plunger channel as the button rotates.

In addition to preventing the firing pin from moving and thus preventing the firearm from being used, the present locking mechanism, when the lock button has been rotated to the locked position, prevents the bolt assembly from being cocked. For example, when the lock button has been rotated to the locked position to prevent movement of the firing pin, the bolt assembly cannot be rotated to cock the firing pin because the firing pin cannot move relative to the bolt body, and thus the firearm cannot be cocked. It is preferred that the locking mechanism be used to lock the firearm when the bolt is in the open position, so that, as described above, the bolt cannot be closed and the firearm cannot be cocked.

The locking mechanisms of the present invention can also be used to lock the firing pin of a bolt action firearm when the bolt is in the closed position. When in the closed position, the firing pin is typically cocked and held in place by the interaction of the firing pin head and the sear (not shown), a component of the trigger assembly/fire control. When the lock button is rotated to the locked position, the firing pin is prevented from moving by the button even if the trigger is pulled and the firing pin head is released from its interaction with the sear. In such circumstances, the bolt assembly cannot be opened because the firing pin is prevented from moving with respect to the bolt body, and thus the firearm cannot be loaded with a round of ammunition, assuming there is no round of ammunition within the chamber of the firearm.

As shown in the Figures, the preferred lock button 20 of the present invention is substantially cylindrical in shape. A substantially cylindrical shape is preferred for aesthetic reasons and for ease in incorporating the present invention into various types of firearms, however, other shapes and configurations are within the scope of the present invention and will be evident to those skilled in the art, depending on the overall configuration of the firearm for which the present locking mechanism will be used.

Embodiments of the key 50 shown herein include one preferred locking means adapted for insertion into the female receiving end of the locking aperture. Other locking means can include a wire or rod and a blade. Although a wide variety of locking means can be used, a key is preferred. The key is adapted for insertion into the locking aperture, extending a sufficient distance into the aperture so as to be positioned to interact with the detent plunger 20 when the detent plunger is positioned within the plunger aperture. The preferred key has a beveled tip, as shown in FIGS. 1 and 8–10. The beveled tip is adapted to interact with the detent plunger as the key is fully inserted into the locking aperture, urging the plunger away from the lock button and out of the plunger aperture and allowing the safety button to be rotated out of the locked position to the unlocked position.

Figure 8:
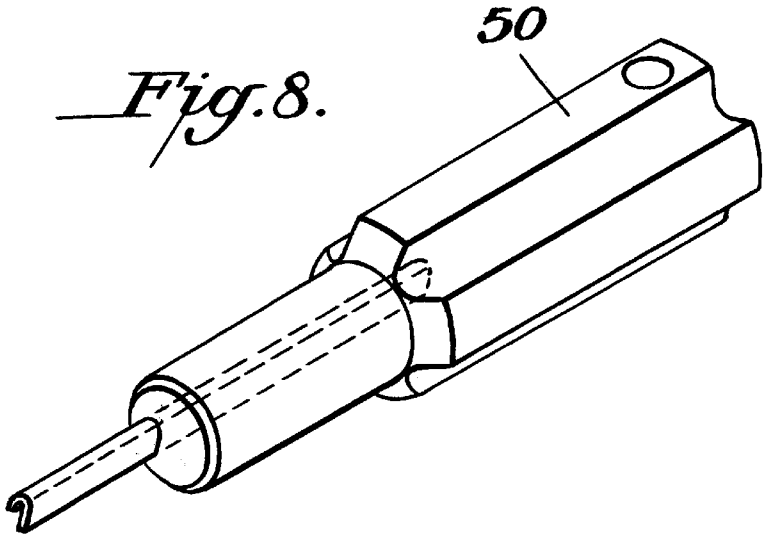
FIG. 8 is a side elevational view of a locking means of the present invention.
Figure 9:
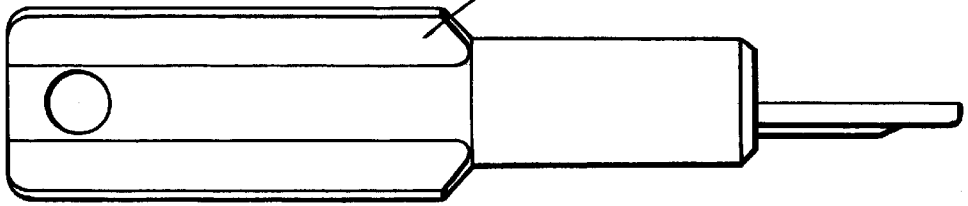
FIG. 9 is a top plan view of the locking means of FIG. 8.
Figure 10:
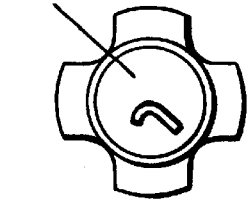
FIG. 10 is a front plan view of the locking means of FIG. 8.

The key can comprise a variety of handles, including the cylindrical handle shown in FIGS. 8–10.

It is preferred that the key have high torsional strength, yet also have a thin cross section to make the key difficult to copy. A thin key will also deter the use of paper clips and other readily available articles from being used to "pick" the locking mechanism. Many known means of imparting torsional strength can be used, including selecting a suitable material. In addition, the key can be configured to increase its torsional strength. For example, the key can be formed from a piece of metal which has been bent, the bend providing rigidity and torsional strength. As shown in the Figures, preferred keys can have a "j" shaped cross section, showing one possible way of providing a key having high torsional strength. Other cross sectional configurations will also impart torsional strength to the key, as will be evident to those skilled in the art.

The various embodiments of the locking mechanisms of the present invention are adaptable with minor modifications to a wide variety of firearms.

I claim:

1. A firearm having a firing pin and a locking mechanism comprising:

a lock button, rotatable between an unlocked position, wherein the lock button permits movement of the firing pin, and a locked position, wherein the lock button prevents movement of the firing pin, wherein the lock button comprises a longitudinal axis, a surface, and a first end and a second end, and;

i. a locking aperture formed along the longitudinal axis of the button and comprising a female receiving end formed in the first end of the button;

ii. a notch formed in the surface of the button between the first and second ends of the button; and iii. a plunger aperture formed in the surface of the button between the first and second ends of the button, and wherein the locking mechanism further comprises a detent plunger, and a locking means for insertion into the female receiving end of the locking aperture of the safety button, and wherein the plunger aperture is connected to the locking aperture, and wherein the firing pin has a notch formed therein positioned and configured to interact with the notch of the lock button.

2. A firearm having a locking mechanism of claim 1 wherein the plunger aperture extends substantially transverse to the longitudinal axis of the button toward the central axis of the button to connect with the longitudinal locking aperture.

3. A firearm having a locking mechanism of claim 1 wherein the locking means is adapted to interact with the plunger aperture when inserted into the female receiving end.

4. A firearm having a locking mechanism of claim 1 wherein the detent plunger is urged towards the safety button by a spring.

5. A firearm having a locking mechanism of claim 1 further comprising a rotational position indicator formed on one end of the lock button.

6. A firearm having a locking mechanism of claim 1 wherein the locking means is a key.

7. A firearm having a locking mechanism of claim 6 wherein the key has a substantially "J" shaped cross sectional configuration.

8. A firearm having a locking mechanism of claim 1 wherein the locking means is a key adapted to urge the detent plunger away from the lock button when the key is inserted into the locking aperture.

9. A firearm having a locking mechanism of claim 8 wherein the locking means is adapted to interact with the plunger aperture only when the locking means is fully inserted into the female receiving end.

10. A firearm having a locking mechanism of claim 1 wherein the lock button further comprises at least one longitudinal slot and the firing pin further comprises a tab adapted to interact with the at least one slot to prevent movement of the firing pin.

11. A firearm having a locking mechanism of claim 10 wherein the lock button comprises two parallel longitudinal slots and the firing pin further comprises a tab adapted to interact with either slot to prevent movement of the firing pin.

12. A bolt action firearm having a bolt assembly comprising a hollow bolt body, a bolt handle, a bolt plug, a firing pin and firing pin spring within the bolt body, and a locking mechanism comprising a lock button having a longitudinal axis, a surface, and a first end and a second end, and comprising;

i. a locking aperture formed along the longitudinal axis of the button and comprising a female receiving end formed in the first end of the button;

ii. a notch formed in the surface of the button between the first and second ends of the button; and iii. a plunger aperture formed in the surface of the button between the first and second ends of the button and connected to the locking aperture, and wherein the locking mechanism further comprises a detent plunger, and a locking means for insertion into the female receiving end of the locking aperture of the safety button, and wherein the lock button is moveable among a locked and an unlocked position, and wherein the firing pin has a notch formed therein positioned and configured to interact with the notch of the lock button to permit movement of the firing pin when the lock button is in the unlocked position and to prevent movement of the firing pin when the lock button is in the locked position.

13. A firearm of claim 12 wherein the locking mechanism is positioned within the bolt assembly.

14. A firearm of claim 13 wherein the locking mechanism is positioned within the bolt plug.

15. A firearm of claim 12 further comprising a receiver wherein the bolt assembly is moveably mounted, and wherein the locking mechanism is positioned in the receiver, and wherein the lock button is positioned to contact the bolt assembly to prevent movement thereof when the lock button is in the locked position, and wherein the lock button is positioned to permit movement of the bolt assembly when in the unlocked position.

16. A firearm of claim 12 further comprising a receiver wherein the bolt assembly is moveably mounted, and wherein the locking mechanism is positioned in the receiver, and wherein the lock button is positioned to contact the bolt assembly and the firing pin to prevent movement thereof when the lock button is in the locked position, and wherein the lock button is positioned to permit movement of the bolt assembly and firing pin when in the unlocked position.

17. A firearm of claim 12 wherein the lock button further comprises at least one longitudinal slot formed therein and the firing pin further comprises a tab adapted to interact with the at least one slot to prevent movement of the firing pin.

18. A firearm of claim 17 wherein the lock button comprises two parallel longitudinal slots and the firing pin further comprises a tab adapted to interact with either slot to prevent movement of the firing pin.

19. A firearm having a firing pin and a locking mechanism comprising:

A. a lock button having a longitudinal axis, a surface, a first end and a second end, and comprising:

i. a locking aperture formed along the longitudinal axis of the button comprising a female receiving end formed in the first end of the button;

ii. a notch formed in the surface of the button between the first and second ends of the button;

iii. a plunger aperture formed in the surface of the button between the first and second ends of the button, extending substantially transverse to the longitudinal axis of the button toward the central axis of the button and connecting with the substantially longitudinal locking aperture;

iv. a plunger channel formed in the surface of the button between the first and second ends thereof, and connected to the plunger aperture;

B. a detent plunger;

C. a spring positioned to bias the detent plunger towards the lock button and into a position where the detent plunger interacts with the plunger aperture and plunger channel; and D. a key adapted for insertion into the female receiving end of the locking aperture of the button, wherein the key is adapted to interact with the plunger aperture when inserted into the female receiving end; and wherein the firing pin has a notch formed therein and adapted to interact with the notch of the lock button.

20. A firearm having a locking mechanism of claim 19 wherein the detent plunger interacts with the plunger channel to retain the lock button and to define and restrict the rotational movement of the button.

21. A firearm having a locking mechanism of claim 19 wherein the key has a substantially curved cross sectional configuration.

22. A firearm of claim 19 wherein the lock button further comprises at least one longitudinal slot formed therein and the firing pin further comprises a tab adapted to interact with the at least one slot to prevent movement of the firing pin.

23. A firearm of claim 22 wherein the lock button comprises two parallel longitudinal slots and the firing pin further comprises a tab adapted to interact with either slot to prevent movement of the firing pin.

* * * * *